US006729061B1

(12) United States Patent
DeJarnette, Jr.

(10) Patent No.: US 6,729,061 B1
(45) Date of Patent: May 4, 2004

(54) COUPLING DEVICE FOR ADDING A SHOULDER STOCK TO A HANDGUN

(76) Inventor: Rogers P. DeJarnette, Jr., 3390 County Line Rd., Cullen, VA (US) 23934

( * ) Notice: Subject to any disclaimer, the term of this patent is extended or adjusted under 35 U.S.C. 154(b) by 63 days.

(21) Appl. No.: 09/672,492

(22) Filed: Sep. 29, 2000

(51) Int. Cl.[7] ..... F41C 23/12

(52) U.S. Cl. ..... 42/71.02; 42/72; 42/146; 42/1.16

(58) Field of Search ..... 42/71.02, 124, 42/125, 126, 127, 128, 94, 146, 1.16, 72

(56) References Cited

U.S. PATENT DOCUMENTS

| | | | | |
|---|---|---|---|---|
| 2,539,008 A | * | 1/1951 | Brookhyser | |
| 3,374,544 A | * | 3/1968 | Pitchford | |
| 3,724,372 A | * | 4/1973 | Phillips | 86/1 A |
| 4,327,984 A | * | 5/1982 | Evans | 354/270 |
| 4,591,748 A | * | 5/1986 | Greer | 211/1.5 |
| 4,913,391 A | * | 4/1990 | Klipp | 248/214 |
| 4,989,358 A | | 2/1991 | Aronson et al. | |
| 5,636,531 A | * | 6/1997 | Miller | 63/15.6 |
| 5,758,209 A | * | 5/1998 | Rogers | 396/103 |
| 5,787,630 A | * | 8/1998 | Martel | 42/101 |

OTHER PUBLICATIONS

Webster's New World Dictionary; 1968; p. 1166.*
Webster's Ninth New Collegiate Dictionary; 1985; p. 942.*
The American Heritage Dictionary; 1976; p. 1047.*

* cited by examiner

*Primary Examiner*—Stephen M. Johnson
(74) *Attorney, Agent, or Firm*—Norman B. Rainer

(57) ABSTRACT

A coupling device for enabling an elongated item of police equipment to be rapidly employed as a shoulder stock for use with a handgun includes a rigid mounting ring having a forwardly directed rigid prong, and a diametrically located set screw for adjustable engagement with the elongated item. The prong is adapted to fit within a recess at the base of the handgrip of a handgun, thereby establishing stabilized joinder with the handgun. Suitable elongated items include batons and flashlights.

8 Claims, 3 Drawing Sheets

COUPLING DEVICE FOR ADDING A SHOULDER STOCK TO A HANDGUN

BACKGROUND OF THE INVENTION

1. Field of the Invention

This invention relates to improvements in the accurate use of a handgun by a police officer, and more particularly concerns apparatus which permits improvised use of police equipment as a shoulder stock attachment for a handgun.

2. Description of the Prior Art

Handguns are routinely carried by law enforcement officers, usually in belt-worn holsters. Most such handguns are currently of semi-automatic firing design, having a hand grip that accommodates a spring-activated magazine of ammunition. At the base of the hand grip there is generally a recess which facilitates engagement of the handgun by a lanyard or tether.

The handgun is well suited for shooting quickly at targets at relatively short distances. However, at longer ranges, handguns are not as accurate as rifles, which are usually not immediately accessible to the officer. Rifles and other shoulder held firearms have greater accuracy because of their longer barrel length, longer sighting radius, and the steadiness provided by a shoulder stock.

There are several disclosures in the prior art of devices which can be quickly and temporarily attached to a handgun to serve as a shoulder stock for bracing the weapon to assist the shooter in acquiring greater accuracy. For example, U.S. Pat. No. 4,989,358 to Aronson, et. al. describes an adapter which enables a policeman's baton to be coupled to a handgun in a manner which enables the baton to function as a shoulder stock for the handgun.

Although the Aronson adapter makes good use of a readily available item of police equipment, namely the baton, it does not allow for any adjustability in the effective length of the improvised shoulder stock. The Aronson adapter also must be specially contoured to fit the hand grip of a specific handgun, thereby requiring a customized adapter for each of various models of handgun that police officers might carry.

It is accordingly an object of the present invention to provide a coupling device to facilitate the use of an item of commonly employed police equipment as an improvised shoulder stock for a handgun.

It is another object of this invention to provide a coupling device as in the foregoing object which is particularly useful with an elongated item of police equipment.

It is a further object of the present invention to provide a coupling device of the aforesaid nature which interacts at adjustable lengths with an elongated item of police equipment.

It is yet another object of this invention to provide a coupling device of the aforesaid nature which facilitates simultaneous use of a flashlight pointed in the direction of aim of the handgun.

It is an additional object of the present invention to provide a coupling device of the aforesaid nature having versatility of interaction with handguns having a recess at the base of their hand grip.

It is a still further object of this invention to provide a coupling device of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a coupling device for interaction between an elongated object of police equipment and a handgun whose hand grip has a recess, said coupling device comprising:

a) a rigid mounting ring comprised of a sidewall of flat band configuration that defines a circular interior aperture having a center axis, circular outer wall, forward and rearward edges, and upper and lower extremities, b) a prong attached to said upper extremity and directed forwardly of said forward edge in parallel relationship to the axis of said interior aperture, and c) manually operable securing means interactive with said sidewall at said lower extremity to permit controlled engagement with an object disposed within said interior aperture.

In an alternative embodiment of the coupling device of this invention, an annular retaining surface may be associated with said forward edge and disposed within said interior aperture.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
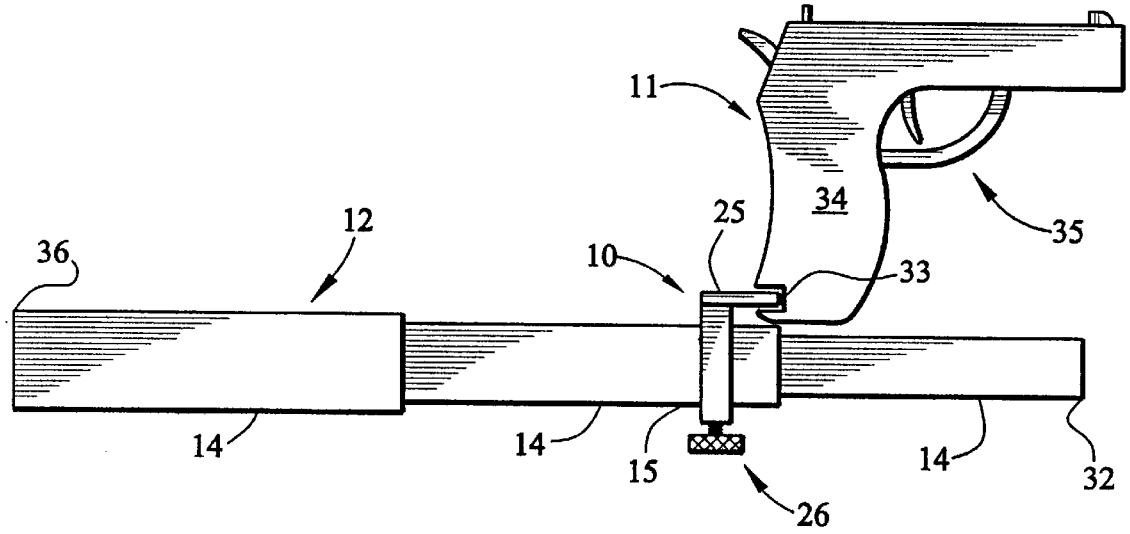
FIG. 1 is a side view of an embodiment of the coupling device of this invention shown in functional association with an extensible police baton and a handgun.
Figure 2:
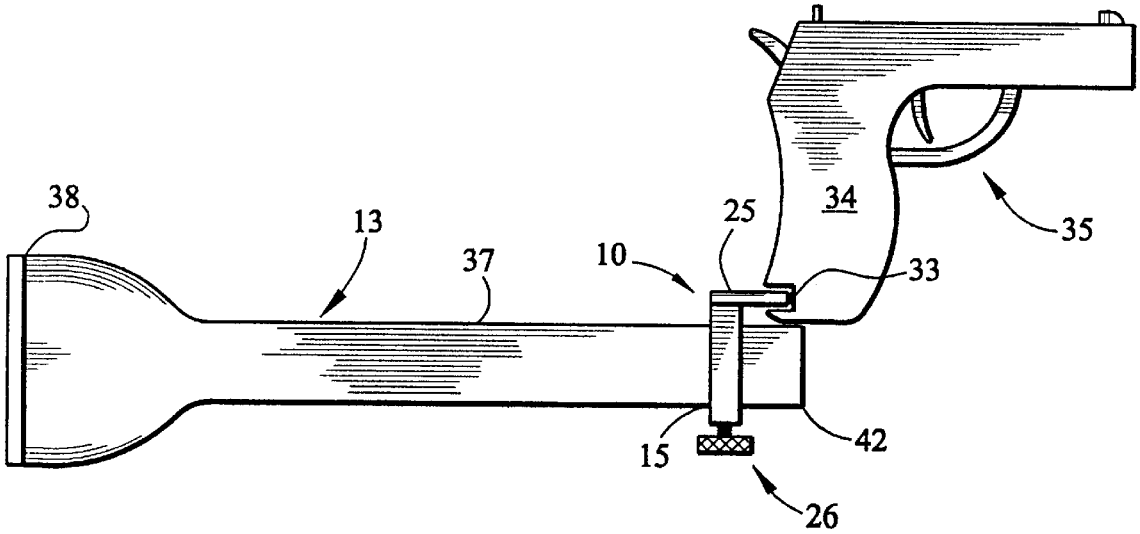
FIG. 2 is a side view of the coupling device of FIG. 1 shown in a first mode of association with a flashlight.
Figure 4:
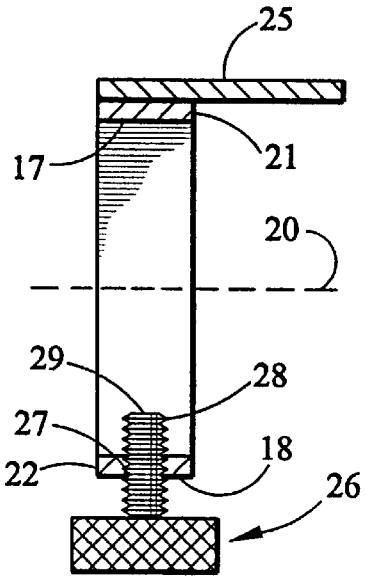
FIG. 4 is a sectional view taken in the direction of the arrows upon the line 4—4 of FIG. 3.
Figure 6:
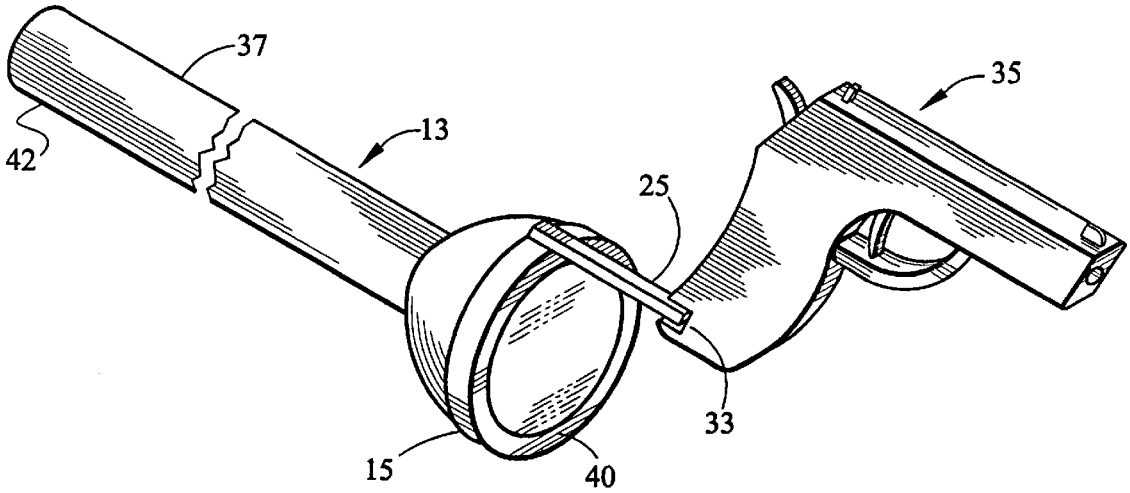
FIG. 6 is a front perspective view of the coupling device of FIG. 5 shown in a second mode of association with a flashlight.

Referring now to FIGS. 1–4 an embodiment of the coupling device 10 of the present invention is shown in functional relationship with a handgun 11, an extensible police baton 12, as in FIG. 1, and with a flashlight 13 of elongated design, as in FIGS. 2 and 6.

Baton 12 is in widespread current use by police and other law enforcement officers. The baton is constructed of at least three telescopically interactive sections 14 of heavy gauge steel construction. As a standard equipment item, it is usually carried by the officer either on a holster belt or in ready access proximity in a patrol car. The baton, generally stored in its compact state, is quickly deployed to its full extent by a quick snap action. In its fully extended state, the baton has a length of about 2 feet.

Coupling device 10 is comprised of a rigid mounting ring 15 consisting of sidewall 16 of flat band configuration and preferably of metal construction. The exemplified embodiment of sidewall 16 is shown to have a cross section bounded by flat interior and exterior surfaces 17 and 18, respectively, said cross section being uniform throughout ring 15. Sidewall 16 defines a circular interior aperture 19 having center axis 20, and further defines forward and rearward edges, 21 and 22, respectively, and upper and lower extremities 23 and 24, respectively.

The diameter of aperture 19 may range between ¼ and 3 inches. The length of sidewall 16, measured between said forward and rearward edges, may range between 0.25 and 1.50 inch. The thickness of said sidewall, measured orthogonally between said interior and exterior surfaces, may range between 0.10 and 0.50 inch.

Figure 3:
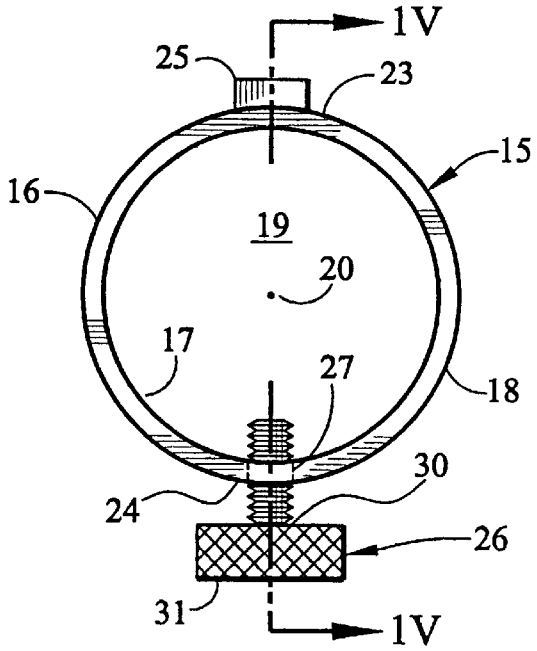
FIG. 3 is an enlarged front view of the embodiment of the coupling device of FIG. 1.

A rigid metal prong 25 is attached to exterior surface 18 at upper extremity 23, and is forwardly directed in parallel relationship to axis 20. The length of prong 25 which extends forwardly of forward edge 21 is in the range of 0.3 to 1.0 inch. Prong 25 is preferably a piece of steel rod having a rectangular cross-sectional configuration, as shown in FIG. 3. The rectangular cross-section has been found to provide stabilized interaction with the recess 33 at the base of the handgrip 34 of a handgun 35. In particular, a rectangular prong minimizes or prevents twisting movement of the gun with respect ot the improvised elongated stock. Attachment of prong 25 to sidewall 16 may be by way of welding, threaded fasteners, or splined dovetail insertion which permits removal and replacement with prongs of different configuration. Alternatively, prong 25 may be a continuous integral extension of said sidewall, formed in a molding operation that produces said sidewall and prong as a combined monolithic structure.

Manually operable securing means in the form of set screw 26 is interactive with said sidewall at lower extremity 24. Said set screw 26 engages a threaded hole 27 in said sidewall located in diametric opposition to prong 25. Set screw 26 is comprised of a threaded shaft portion 28 having an interiorly directed abutment extremity 29, and an exterior extremity 30. Gripping means in the form of knurled head 31 is attached to said exterior extremity.

In one manner of use of the coupling device, as illustrated in FIG. 1, the device is entered onto the narrow extremity 32 of a fully extended baton 12. Head 31 is then tightened by finger manipulation at a site on the baton predetermined to provide an acceptable length of an improvised shoulder stock. Prong 25 is then inserted into the recess 33 at the base of the hand grip 34 of semi-automatic handgun 35. The wide extremity 36 of baton 12 is then placed against the shooter's shoulder as though it were the shoulder stock of a rifle. One of the shooter's hands holds the hand grip and operates the trigger of the handgun. The shooter's other hand may be placed upon the trigger hand or on the baton to create an even steadier hold on the handgun.

In another mode of use, as shown in FIG. 2, the coupling device of this invention is emplaced upon the rear extremity 42 of a standard issue flashlight 13 having an elongated battery compartment 37. Head 31 is tightened at a predetermined site on the battery compartment, and prong 25 is caused to enter recess 33 in hand grip 34. The front end 38 of the flashlight is placed against the shooter's shoulder as though the flashlight were the shoulder stock of a rifle. In an alternative manner of use of the coupling device in association with a flashlight, the device can be mounted upon battery compartment 37 in the opposite direction from that shown in FIG. 2. In such case, prong 25 is directed toward the front end of the flashlight, enabling the gun to be aimed in the same direction as the beam from the flashlight, while the rear extremity 42 of the flashlight abuts the shooter's shoulder.

Figure 5:
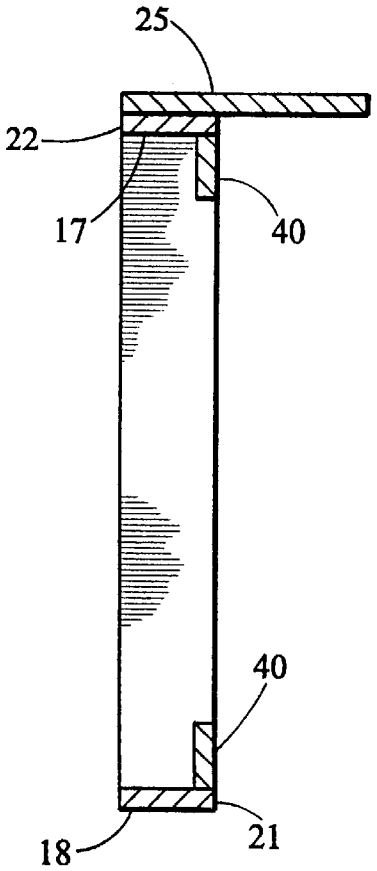
FIG. 5 is an enlarged vertical sectional view of an alternative embodiment of the coupling device of this invention.

In a further mode of use, the alternative embodiment of the coupling device shown in FIG. 5 is applied as shown in FIG. 6 to the front end 38 of said flashlight. An annular retaining shoulder 40 associated with forward edge 21 and disposed within interior aperture 19 serves as an abutment surface for the front end of the flashlight. Head 31 may be tightened to secure the coupling device onto the flashlight. The rear extremity 42 of the flashlight is then placed against the shooter's shoulder as though it were the shoulder stock of a rifle.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A coupling device of metal construction for interaction between an elongated object of police equipment and a handgun whose hand grip has a recess, said coupling device comprising:

a) a rigid mounting ring comprised of a sidewall of flat band configuration that defines a circular interior aperture having a diameter between ¼ and 3 inches, a center axis, forward and rearward edges, and upper and lower extremities, said sidewall having a uniform cross-section bounded by flat interior and exterior surfaces, the length of said sidewall measured between said forward and rearward edges being between 0.025 and 1.50 inch, b) a prong attached to said upper extremity and directed forwardly of said forward edge in parallel relationship to said axis, and c) manually operable securing means interactive with said sidewall at said lower extremity to permit controlled engagement with an object disposed within said aperture.

2. The coupling device of claim 1 wherein the thickness of said sidewall, measured orthogonally between said interior and exterior surfaces, is between 0.10 and 0.50 inch.

3.The coupling device of claim 2 wherein the length of said prong extending forwardly of said forward edge is between 0.3 and 1.0 inch.

4. A coupling device for interaction between an elongated object of police equipment and a handgun whose hand grip has a recess, said coupling device comprising:

a) a rigid mounting ring comprised of a sidewall of flat band configuration that defines a circular interior aperture having a center axis, forward and rearward edges, and upper and lower extremities, b) a prong of rectangular cross-sectional configuration attached to said upper extremity and directed forwardly of said forward edge in parallel relationship to si axis, and c) manually operable securing means in the form of a screw threadably interactive with said sidewall at said lower extremity to permit controlled engagement with an object disposed within said aperture, said set screw being provided with gripping means in the form of a knurled head.

5. The coupling device of claim 4 further provided with an annular retaining shoulder associated with said forward edge and disposed within said interior aperture.

6. A coupling device of metal construction for interaction between an elongated object of police equipment and a handgun whose hand grip has a recess, said coupling device comprising:

a) a rigid mounting ring comprised of a sidewall of flat band configuration that defines a circular interior aperture having a diameter between ¼ and 3 inches, a center axis, forward and rearward edges, and upper and lower extremities, said sidewall being of uniform cross-section bounded by interior and exterior surfaces, and having a length, measured between said forward and rearward edges of between 0.025 and 1.50 inch, b) a prong attached to said upper extremity and directed forwardly of said forward edge in parallel relationship to said axis, and c) manually operable securing means interactive with said sidewall at said lower extremity to permit controlled engagement with an object disposed within said aperture.

7. The coupling device of claim 6 wherein the thickness of said sidewall, measured orthogonally between said interior and exterior surfaces, is between 0.10 and 0.50 inch.

8. The coupling device of claim 7 wherein the length of said prong extending forwardly of said forward edge is between 0.3 and 1.0 inch.

* * * * *